United States Patent [19]

Schneider et al.

[11] Patent Number: 4,662,852

[45] Date of Patent: May 5, 1987

[54] FLOATING, RECLINING LOUNGE MECHANISM

[75] Inventors: Stephen E. Schneider, Claremont; Douglas A. Geller, Arcadia; Richard E. Morrison, Temple City, all of Calif.

[73] Assignee: Kransco Manufacturing, Inc., San Francisco, Calif.

[21] Appl. No.: 822,204

[22] Filed: Jan. 24, 1986

[51] Int. Cl.[4] ..... B63C 9/08

[52] U.S. Cl. ..... 441/132; 297/317; 297/355

[58] Field of Search ..... 441/129–132; 114/363; 297/19, 354, 355, 362, 373, 374, 317, 318, 320, 321, 322

[56] References Cited

U.S. PATENT DOCUMENTS

| | | | |
|---|---|---|---|
| 847,332 | 3/1907 | Hart . | |
| 2,730,162 | 6/1953 | Davis . | |
| 3,049,376 | 1/1961 | Rosenthal . | |
| 3,074,759 | 3/1960 | Bergenwall . | |
| 3,117,327 | 1/1962 | Mathew | 441/132 |
| 3,142,512 | 2/1962 | Hamilton et al. . | |
| 3,235,304 | 2/1966 | Glass | 297/19 |
| 3,337,266 | 8/1967 | Burns | 297/317 |
| 3,947,069 | 3/1976 | Lusch | 297/317 |
| 3,984,888 | 10/1976 | DeLano . | |
| 4,035,021 | 7/1977 | Krug | 297/369 |
| 4,251,107 | 2/1981 | Sato | 297/19 |

*Primary Examiner*—Joseph F. Peters, Jr.
*Assistant Examiner*—Stephen P. Avila
*Attorney, Agent, or Firm*—Limbach, Limbach & Sutton

[57] ABSTRACT

A floating, reclining lounge (10) including a mechanism to permit it to be easily adjusted in the aquatic environment without the need for manually applied lifting force. In one embodiment, the mechanism includes a slotted bracket (30) with resilient sockets which enable the seat of the lounge to be moved and secured in select positions of adjustment. In another embodiment, the mechanism include a slotted bracket (100) having a rack (110) and pinion (108) to facilitate such adjustment.

4 Claims, 6 Drawing Figures

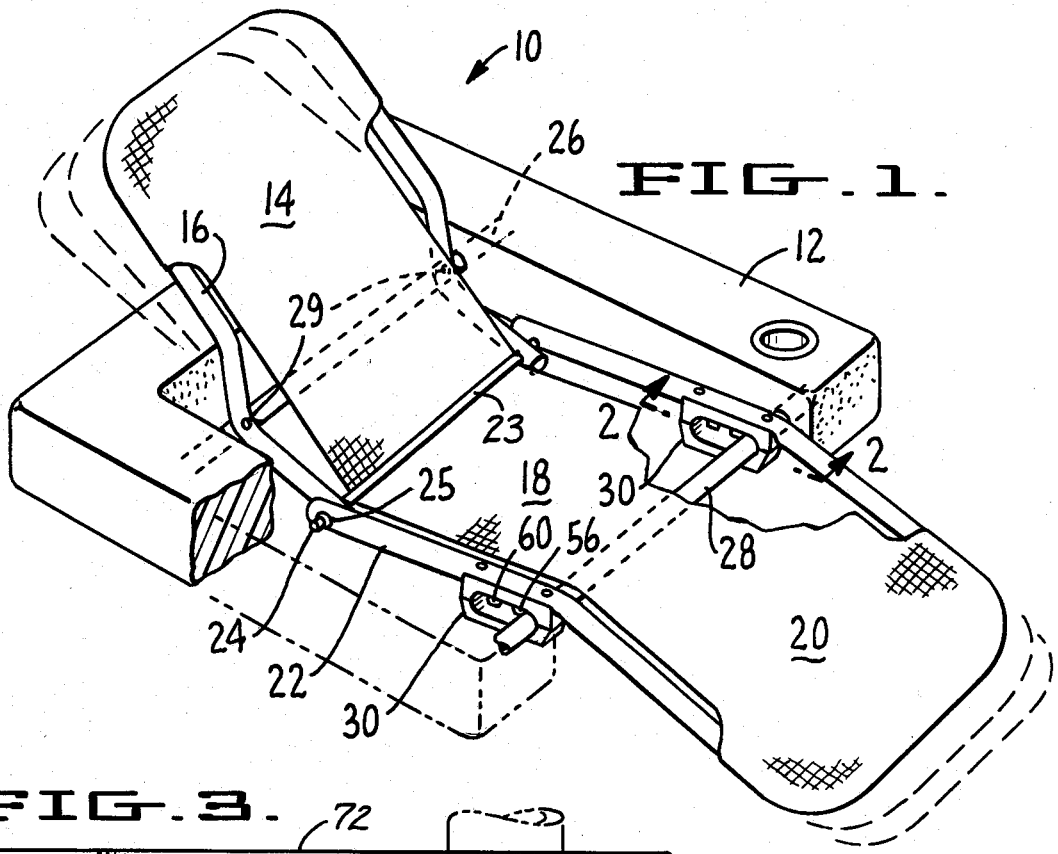
FIG. 1.
FIG. 3.
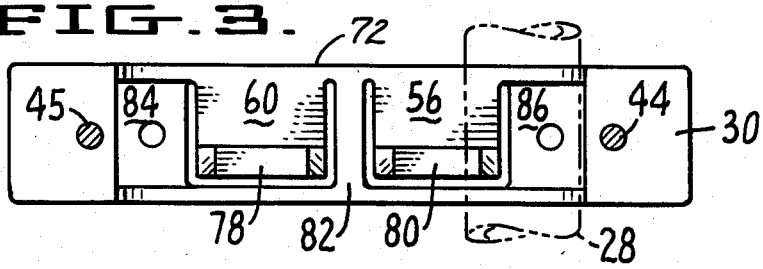
FIG. 2.
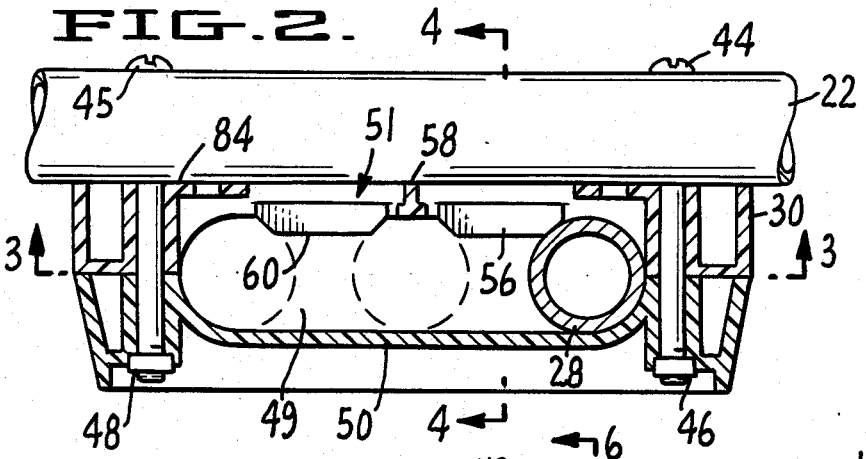
FIG. 4
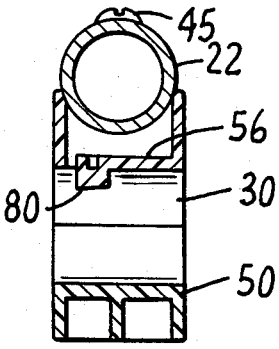
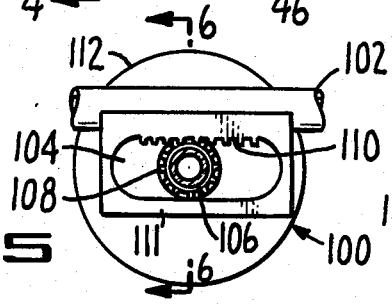
FIG. 5
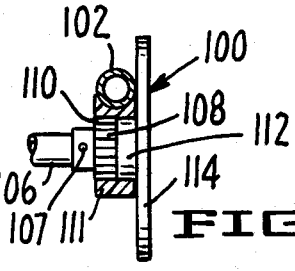
FIG. 6

FLOATING, RECLINING LOUNGE MECHANISM

TECHNICAL FIELD

This invention relates generally to floating, reclining lounges, and more particularly to a reclining lounge which has an adjustment mechanism which does not require manual lifting for activation.

BACKGROUND OF THE INVENTION

The popularity of backyard swimming pools has sparked the development of recreational devices for use and enjoyment in such pools. One area of considerable development is in floating lounges which permit the swimming pool enthusiast to enjoy the cooling effects of the water without need for the exertion required to stay afloat. Traditional ground based lounge chair ergonomics do not translate well to the aquatic environment. The awkwardness created by the water's buoyant effects makes lounge stability a particularly challenging design problem.

Previous designs for reclining chairs and infant seats provide background for the problems faced by the floating lounge designer. U.S. Pat. No. 3,074,759 to Bergenwall describes a reclining lounge chair. The angle of recline is adjusted by the use of a pivotal lever which cooperates with a toothed rack to move the seat relative to the support frame. U.S. Pat. No. 3,142,512 to Hamilton et al. claims an infant seat whose two sections are pivotally joined to permit rotation about a common axis. Several embodiments are disclosed. In one, corrugated bracket members are fastened to the underside of the seat. A cross member is received within the corrugated bracket and held in place by a leaf spring. Manually applied lifting pressure against the leaf spring permits adjustment of the seat relative to the cross member. This movement translates into angle adjustment as the two sections rotate about a common axis.

The mechanisms disclosed in the prior art exhibit the same shortcoming when the difficulty of recline angle is faced in the aquatic environment. Both mechanisms require the manual application of force to cause movement of the seat relative to its support framework. While the difficulty presented by this requirement for land based lounges is minimal, major problems are encountered in aquatic use. Manual operations in hard to reach locations cause lounge instability which may cause the pool enthusiast to be unwittingly dumped into the water. The buoyancy of the floating lounge support also presents characteristic responses vastly different from the support structures of land based lounges. The present invention provides an improved floating lounge which does not require manual input and is thereby inherently more stable.

Therefore, it is an object of this invention to provide a floating lounge which is stable in normal use.

It is a further object of this invention to provide a lounging angle adjustment mechanism which does not require manually applied lifting force.

It is yet another objective of this invention to provide a reclining lounge particularly suitable for aquatic use.

It is a still further object of this invention to provide an adjustable, reclining mechanism which is easy to use.

SUMMARY OF THE INVENTION

The present invention provides a floating, reclining lounge which comprises a U-shaped float, an upright backrest, a seat member which is received within the U-shaped float, and means for pivotally interconnecting the backrest to the seat member. The improvement provides means for pivotally supporting the backrest on the float and a support bar for slidably supporting the seat member on the ring. Adjustment means is provided for selectively positioning the seat member relative to the bar, without need for manually applied lifting force. The adjustment means comprises a slotted bracket fastened to the underside of the seat member for receiving the bar, said bracket having fixed means securing the bar against movement away from the seat member and movable means for selectively locking the bar against slidable movement relative to the seat member.

BRIEF DESCRIPTION OF THE FIGURES

FIG. 1 is a perspective view of a floating, reclining lounge, partially cut away to reveal the seat member and a first embodiment of the adjusting bracket.

FIG. 2 is a cross-sectional view of the adjusting bracket taken along the line 2—2 in FIG. 1.

FIG. 3 is a top view of the first embodiment adjusting bracket.

FIG. 4 is a cross-sectional view of the adjusting bracket taken along the line 4—4 in FIG. 2.

FIG. 5 is a detailed view of another embodiment of the adjusting bracket.

FIG. 6 is a cross-sectional view of the cog-type adjusting bracket taken along the line 6—6 in FIG. 5.

DETAILED DESCRIPTION OF THE INVENTION

A floating, reclining lounge 10 is shown in FIG. 1. A U-shaped float 12 is used to provide buoyancy to the lounge 10 and its occupant (not shown). The float 12 may be made of any number of closed cell polymeric foam products, such as expanded polystyrene. Received within the U-shaped float 12 is an upright backrest 14 which is supported on a backrest frame 16. A seat 18 and a leg support 20 are also received within the U-shaped float 12. It will be apparent to those skilled in the art that leg support 20 is merely a preferred embodiment of the reclining lounge. It is intended that a reclining lounge having only a seat 18 is within the scope of this invention. The seat 18 and leg support 20 are stretched over a seat frame 22.

In the preferred embodiment, both the backrest frame 16 and the seat frame 22 are tubular. Frames 16 and 22 are essentially U-shaped having open ends. A cross member 23 is provided to pivotally interconnect the seat frame 22 and backrest frame 16 at their respective open ends. Cross member 23 is freely received within apertures 24 provided in each of the frames 16 and 22. A nut 25 is provided to secure the ends of cross member 23 so that frames 16 and 22 do not become disconnected. Cross member 23, in this preferred embodiment is placed on top of the webbing or fabric which makes up the backrest 14 and seat 18. It is intended that other means for pivotally interconnecting the upright backrest 14 and seat 18 which are known to those skilled in the art are within the scope of the appended claims.

The upright backrest 14 and seat 18 are supported by first and second bars 26 and 28, respectively. Bars 26 and 28 are positioned transversely to the U-shaped float 12. The bars 26 and 28 are fastened to the float 12 by extending the ends of the bars into the solid material which forms the float 12. It is important, at least for the first bar 26, that the bar be fastened to the float 12 in a manner which does not restrict rotational movement of the bar about its longitudinal axis. Other possibilities for supporting and fastening the bars include brackets which could be fixed to the float inner wall with the bar ends received within the brackets. This, and other means for supporting the bars, are intended to be within the scope of this invention.

The backrest frame 16 is joined to the first bar 26 by bolts 29. The angle of recline of the backrest 14 is not fixed by being fastened to the bar 26. Since bar 26 is free to rotate about its longitudinal axis, the backrest frame 16 is free to rotate about the bar 26 through nearly a quadrant.

The seat 18 is joined to the second bar 28 by brackets 30 which are fixed to the underside of seat frame 22. The second bar 28 is slidably received within the brackets 30 which are aligned so that they are similarly positioned on their respective sides of the seat frame 22.

The lounge 10 can be adjusted to create several angles of recline. In the embodiment of FIGS. 1 to 4, three separate positions for the backrest 14 and leg support 20 are shown. It will be clear to those skilled in the art that the number of possible positions can be chosen to be less than or greater than three, and that lounges with other than three positions are intended to be within the scope of the invention and claims appended hereto. The angle of recline is determined by the position of the seat frame 22 relative to the second bar 28. Movement of the seat frame 22 perpendicular to the bar 28 causes the backrest frame 16 to rotate about the axis of the first bar 26. All of these movements must be easily accomplished to impart to the lounge the stability required for aquatic use. The detail of the preferred embodiment of the bracket 30 which simultaneously controls and facilitates ease of adjustment is shown in the views of FIGS. 2, 3 and 4.

The adjusting brackets 30 are identical and fastened to the seat frame 22 by bracket fastening screws 44 and 45 and bracket fastening nuts 46 and 48. Each bracket captures the bar 28 within a slot 49 bounded by a fixed bottom member 50 and a moveable top member 51. The bottom member 50 secures the bar 28 against movement away from the seat frame 22. The top member 51 serves to selectively lock the seat frame in adjusted condition.

Three positions are defined for the movement of the second bar 28 within the slot 49. The top member 51 is formed with a first tab 56, a sprue 58 and a second tab 60. Tabs 56 and 60 can be moved easily in the vertical plane of FIG. 2. The sprue 58 is a crosspiece which connects the faces of the bracket. The bar 28 can be positioned in one of three flexible sockets indicated by the positions shown in FIG. 2, two of which are represented in broken lines. When the lounge occupant applies force along the horizontal axis of the seat frame, the tabs 56 and 60 will be deflected and the brackets 30 will be moved relative to the second bar 28. Upon the relaxation of such force, the flexible sockets defined by tabs 56 and 60 serve to secure the seat frame to the bar 28 to lock the backrest in select angles of recline determined by the positions of the sockets. The tabs are made flexible to permit ease of manipulation without introducing the requirement that the seat frame be lifted, or that the second bar 28 be manually released from the sockets.

The locking ability of flexible tabs 56 and 60 can be more fully appreciated by reference to the top view of the bracket 30 shown in FIG. 3. At one end, the tabs 56 and 60 are hinged to a wall 72 of the bracket 30. The other ends of the tabs 56 and 60 are free. In this view it can also be seen that the tabs 56 and 60 have locking ridges 78 and 80, respectively. These ridges extend further into the slot 49 than the main body of the tabs. It can also be seen that these locking ridges 78 and 80 have beveled edges which permit the second bar 28 to cam the tabs 56 and 60 upward. Sprue 58 provides support to the bracket walls. The locking ridges are further illustrated in the cross-sectional view of FIG. 4. As there shown, the seat frame 22 is received within the walls of the bracket 30 and bottom members 50 provided overall stability and support to the bracket 30. The locking ridge 80 is located at the free end of tab 56.

Another embodiment of the adjusting bracket, designated 100, is shown in FIG. 5. The bracket 100 is fastened to the seat frame 102 similarly to the fastening of the bracket 30 to the frame 22. A slot 104 formed by the bracket 100 is shaped to accommodate a pinion 108 which is fastened to the second bar 106 by a pin 107. The teeth of pinion 108 cooperate with rack gear 110 at the top of the bracket 100. The bottom of the bracket, designated 111, slidably engages a circular boss 112 formed on the pinion and serves to maintain the pinion in engagement with the teeth 110 and to secure the bar 106 against movement away from the seat frame 102. Discrete adjustment for the angle of recline in this embodiment is provided by turning the pinion through a wheel 114 fixed to the pinion 108. The bar 106 is rotatable about its axis to permit such turning.

Although this invention has been described with reference to specific embodiments, variations which are apparent to those skilled in the art are intended to be within the scope of the appended claims.

We claim:

1. In a floating, reclining lounge which comprises a generally U-shaped float, an upright backrest member having a frame, and a seat member having a frame which is received within said U-shaped float, the improvement comprising:

(a) means for pivotally interconnecting said upright backrest member frame to said seat member frame;

(b) means for pivotally supporting said backrest member frame for movement about an axis extending transversely of the U-shaped float;

(c) a support bar secured to and transversely of the float in spaced generally parallel relationship to said axis; and (d) a bracket fixed to said seat member support frame and having a slot therein slidably receiving said bar to support said seat member support frame on said bar for movement toward and away from said axis, said slot having bar engageable means fixed relative to said seat member support frame to secure the bar against movement away from said frame while permitting slidable movement of said frame relative to the bar while so secured, and movable bar engageable means to selectively lock said seat member support frame at different positions against movement toward and away from said axis.

2. In a floating, reclining lounge according to claim 1, the improvement wherein: the fixed bar engageable means comprises a first surface formed in the slot in generally parallel relationship to the seat member frame; the movable bar engageable means comprises a second surface formed in the slot in apposition to the first surface, said second surface having at least two spaced apart, flexible sockets releasably engageable with the bar to selectively secure the seat member frame at adjusted positions relative to the bar; and cam means formed on said flexible sockets to deflect said sockets out of engagement with said bar in response to the application of force to the seat member support frame to slide the bracket over said bar.

3. In a floating, reclining lounge according to claim 2, the improvement wherein the flexible sockets are defined by resilient tabs secured to the bracket and extending into the slot and the cam means comprise beveled edges formed on said tabs for slidable engagement with said bar.

4. In a floating, reclining lounge according to claim 1, the improvement wherein the fixed bar engageable means comprises a first surface formed in the slot in generally parallel relationship to the seat member frame, and the moveable bar engageable means comprises a pinion rotatably received on the bar and a rack gear within the slot engaged with the pinion.

* * * * *